US008965235B2

(12) United States Patent
Yoon et al.

(10) Patent No.: US 8,965,235 B2
(45) **Date of Patent: *Feb. 24, 2015**

(54) IMAGE FORMING APPARATUS AND METHOD OF CONTROLLING POWER THEREOF

(71) Applicant: Samsung Electronics Co., Ltd., Suwon-si, Gyeonggi-do (KR)

(72) Inventors: Yeo-phil Yoon, Hwaseong-si (KR); Yong-bin Yoon, Seoul (KR); Han-sang Oh, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/061,978

(22) Filed: Oct. 24, 2013

(65) Prior Publication Data

US 2014/0050501 A1 Feb. 20, 2014

Related U.S. Application Data

(63) Continuation of application No. 12/881,462, filed on Sep. 14, 2010, now Pat. No. 8,611,777.

(30) Foreign Application Priority Data

Oct. 9, 2009 (KR) ..... 10-2009-0094666

(51) Int. Cl.
*G03G 15/00* (2006.01)

(52) U.S. Cl.
CPC ..... *G03G 15/80* (2013.01); *G03G 15/5004* (2013.01)
USPC ..... 399/88; 399/37

(58) Field of Classification Search
USPC ..... 399/37, 88
See application file for complete search history.

(56) References Cited

U.S. PATENT DOCUMENTS

| | | | | |
|---|---|---|---|---|
| 5,457,516 | A | 10/1995 | Kim | |
| 8,611,777 | B2 * | 12/2013 | Yoon et al. | 399/88 |
| 2005/0110898 | A1 * | 5/2005 | Ryu | 348/372 |
| 2006/0028903 | A1 | 2/2006 | Hada | |
| 2009/0060537 | A1 | 3/2009 | Nakabayashi | |

FOREIGN PATENT DOCUMENTS

| | | |
|---|---|---|
| CN | 1120188 | 4/1996 |
| CN | 1213255 | 4/1999 |

(Continued)

OTHER PUBLICATIONS

Chinese Office Action dated Mar. 31, 2014 issued in CN Application No. 201010295547.0.

Japanese Office Action dated Jul. 22, 2014 in JP Application No. 2010-226974.

Chinese Office Action issued Nov. 24, 2014 in corresponding Chinese Patent Application No. 201010295547.0, 11 pages.

(Continued)

*Primary Examiner* — Ryan Walsh
(74) *Attorney, Agent, or Firm* — Staas & Halsey LLP

(57) ABSTRACT

An image forming apparatus includes a power supply unit to generate DC power, a plurality of function units to perform the functions of the image forming apparatus, a control unit to control the operation of a plurality of function units, a switching unit to receive DC power of the power supply unit and switch power provided to the control unit and each of a plurality of function units, and a power management unit to receive DC power of the power supply unit and to control a switching operation of the switching unit according to an operation mode of the image forming apparatus.

14 Claims, 9 Drawing Sheets

(56) References Cited

FOREIGN PATENT DOCUMENTS

| | | |
|---|---|---|
| JP | 07-262614 | 10/1995 |
| JP | 07-288613 | 10/1995 |
| JP | 2006-074747 | 3/2006 |
| JP | 2006-173695 | 6/2006 |

OTHER PUBLICATIONS

U.S. Office Action dated Oct. 17, 2012 in U.S. Appl. No. 12/881,462.
Final Office Action dated Feb. 19, 2013 in U.S. Appl. No. 12/881,462.
Notice of Allowance dated Jul. 24, 2013 in U.S. Appl. No. 12/881,462.

* cited by examiner

IMAGE FORMING APPARATUS AND METHOD OF CONTROLLING POWER THEREOF

CROSS-REFERENCE TO RELATED APPLICATIONS

This is a Continuation Application of prior application Ser. No. 12/881,462, filed on Sep. 14, 2010 in the United States Patent and Trademark Office, which claims the benefit of priority under 35 U.S.C. §119(a) from Korean Patent Application No. 2009-94666, filed on Oct. 6, 2009, in the Korean Intellectual Property Office, the contents of which are incorporated herein by reference in its entirety.

BACKGROUND

1. Field of the Invention

The present general inventive concept relates to an image forming apparatus and a method of controlling power thereof, and more particularly, to an image forming apparatus to increase power management efficiency by dividing power for each function of the image forming apparatus, and a method of controlling power thereof.

2. Description of the Related Art

An image forming apparatus performs generating, printing, receiving, and transmitting of an image data, and examples of image forming apparatuses include a printer, a scanner, a copier, a fax machine, and a multi-functional printer.

A general image forming apparatus provides power to a control unit and other main devices of the image forming apparatus using a power supply or a converter. More specifically, the power supply converts AC power input from outside the image forming apparatus into a basic DC power, and the converter generates the secondary power used for the control unit and other main devices of the image forming apparatus utilizing the basic DC power. A conventional image forming apparatus performs booting by supplying a reset signal to a control unit when power is provided to the image forming apparatus, using a reset unit to generate the reset signal for the control unit.

However, in conventional image forming apparatuses, it may be difficult to manage power efficiently since the conventional image forming apparatus controls on/off only for each power source when converting the basic DC power into the secondary DC power. In addition, as the control unit and other main devices of the image forming apparatus are reset all together when power is stabilized, it may be difficult to control power and control reset of each components according to its function. Furthermore, as power is applied to every component of the image forming apparatus all at once, power is used unnecessarily, compromising low power operation.

Conventionally, a control unit controls overall function of an image forming apparatus, and thus the control unit is always in operation, even in a power save mode. Therefore, it is not easy to perform a low power operation.

Conventionally, a reset signal for each component may be controlled using hardware, and thus a reset signal may be generated if an output level of the power supply drops below a certain level, which may cause a system lock-up.

SUMMARY OF THE INVENTION

The present general inventive concept provides an image forming apparatus to increase power management efficiency by dividing power for each function of the image forming apparatus, and a method of controlling power thereof.

Additional features and utilities of the present general inventive concept will be set forth in part in the description which follows and, in part, will be obvious from the description, or may be learned by practice of the general inventive concept.

Features and/or utilities of the present general inventive concept may be realized by an image forming apparatus including a power supply unit to generate DC power, a plurality of function units to perform functions of the image forming apparatus, a control unit to control operation of the plurality of function units, a switching unit to receive DC power of the power supply unit and switch power provided to the control unit and the plurality of function units, and a power management unit to receive DC power of the power supply unit and control switching operation of the switching unit according to an operation mode of the image forming apparatus.

The switching unit may include a converter to convert DC power of the power supply unit into DC power of another level and a plurality of switching elements to provide DC power of the power supply unit and converted DC power of the converter to the control unit and a plurality of function units respectively.

The power management unit may control the plurality of switching elements to be turned on sequentially in a wake-up mode.

In a power-off mode, the power management unit may control the plurality of switching elements so that at least one of the plurality of switching elements is turned on to discharge electric charge accumulated in the image forming apparatus.

The power-off mode may be a mode in which a command to turn off power is received from a user or AC power input to the image forming apparatus is turned off.

The image forming apparatus may further include a reset unit to generate a reset signal input to the power management unit and a reset signal input to the control unit sequentially if the power supply unit generates DC power.

The reset unit may generate a reset signal to be input to the control unit if a predetermined time elapses or a system reset signal is received from the power management unit, after a reset signal to be input to the power management unit is generated.

The predetermined time may be a stabilization time of the power management unit.

The image forming apparatus may further include a storage unit to store a program related to operation of the image forming apparatus, and the reset unit may generate a reset signal for the control unit after generating a reset signal for the storage unit.

The control unit may generate a reset signal for the plurality of function units according to an operation mode of the image forming apparatus.

Features and/or utilities of the present general inventive concept may also be realized by a method of managing power of an image forming apparatus according to an exemplary embodiment of the present general inventive concept may include generating DC power, inputting the DC power to a power management unit of the image forming apparatus, and selectively controlling by the power management unit power that is provided to a control unit and a plurality of function units of the image forming apparatus according to an operation mode of the image forming apparatus.

The method may further include converting the DC power into DC power of another level, and the controlling selectively power may include controlling the DC power and the converted DC power provided to the control unit and the plurality of function units respectively using a plurality of switching elements.

The controlling power may include controlling the plurality of switching elements to be turned on sequentially if the image forming apparatus is in a wake-up mode.

The controlling power may include controlling the plurality of switching elements so that at least one switching element is turned on to discharge electric charge accumulated in the image forming apparatus if the image forming apparatus is in a power-off mode.

The power-off mode may be a mode in which a command to turn off power is received from a user or AC power input to the image forming apparatus is turned off.

The method may further include generating a reset signal to be input to the power management unit and a reset signal to be input to the control unit sequentially if the DC power is generated.

The generating the reset signal may include generating a reset signal to be input to the control unit if a predetermined time elapses or a system reset signal is received from the power management unit, after a reset signal to be input to the power management unit is generated.

The predetermined time may be stabilization time of the power management unit.

The generating the reset signal may include generating a reset signal for the control unit after generating a reset signal for the storage unit to store a program related to an operation of the image forming apparatus.

The method may further include generating a reset signal for the plurality of function units by the control unit according to an operation mode of the image forming apparatus.

Features and/or utilities of the present general inventive concept may also be realized by an image-forming apparatus including a power supply, a plurality of operation modules, each to perform at least one of an imaging function, a processing function, and a communication function of the image-forming apparatus, a switching unit including a plurality of switches to receive power from the power supply and to provide power to the plurality of operation modules, and a power management unit to receive power directly from the power supply to control the plurality of switches of the switching unit to sequentially provide power to the plurality of operation modules.

The switching unit may include a DC-DC converter to receive power from the power supply and to output a power signal having a voltage level different from the voltage level received from the power supply, and the power management unit may control a switch to supply power to the DC-DC converter.

The image-forming apparatus may include a control unit to control operation of each of the plurality of operation modules, and the power management unit may control a switch to supply power to the control unit.

The image-forming apparatus may include a reset unit to provide a first reset signal to the power management unit to boot the power management unit.

The plurality of operation modules may include at least one data storage device, and the reset unit may include a delay circuit to receive the first reset signal and to output a second, delayed reset signal to the at least one data storage device. The reset unit may output the second reset signal to the control unit to simultaneously output the second reset signal to the data storage device and the control unit.

The plurality of operation modules may include at least one of a user interface unit to receive an input from a user and an external device communication unit to receive an input from an external device, and the power management unit may control the plurality of switches to output power to only to the at least one user interface unit or external device communication unit when the image-forming apparatus is in a low-power mode.

When the image-forming apparatus is turned off, the power management unit may control at least one of the plurality of switches to remain on for a predetermined period of time after power is turned off to the rest of the plurality of switches to discharge a charge in the image-forming apparatus.

Features and/or utilities of the present general inventive concept may also be realized by a method of controlling power to an image-forming apparatus, the method including generating a first DC power output based on an AC power input, supplying the first DC power to a switching unit including a plurality of switches and to a power management unit, and controlling the plurality of switches with the power management unit to control power to a plurality of operation units connected to the plurality of switches, respectively.

The switching unit may include a DC-DC converter having an output connected to at least one of the plurality of operation units, and controlling the plurality of switches may include controlling at least one switch to provide power to the DC-DC converter.

The image-forming apparatus may include a control unit to control operation of the plurality of operation units, and the method may include supplying power to the control unit before turning on any one of the plurality of switches to supply power to the plurality of operation units. Controlling the plurality of switches may include sequentially turning on the plurality of switches when the image-forming apparatus is turned on.

The method may further include supplying a reset signal to the power management unit when the first DC power is generated to boot the power management unit.

The method may include delaying the reset signal to generate a second reset signal and providing the second reset signal to at least one of a data storage unit and a control unit to control the plurality of operation units.

The method may include, when the image-forming apparatus is changed from a power-on mode to a power-off mode, controlling at least one of the switches to remain on for a predetermined period of time after the rest of the plurality of switches are turned off to discharge a charge of the image-forming apparatus.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
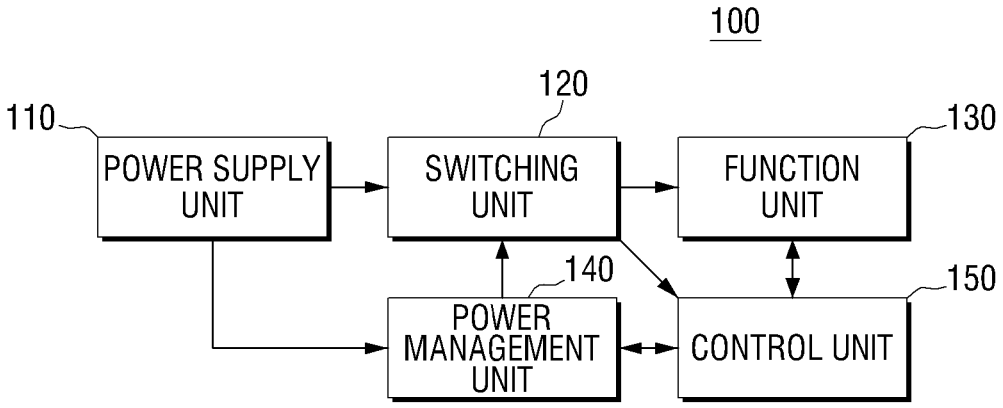
FIG. 1 is a block diagram illustrating the structure of an image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating the structure of an image forming apparatus according to an exemplary embodiment of the present general inventive concept.

Referring to FIG. 1, the image forming apparatus 100 comprises a power supply unit 110, a switching unit 120, a function unit 130, a power management unit 140 and a control unit 150.

The power supply unit 110 generates DC power. Specifically, the power supply unit 110 may be realized as a switching mode power supply (SMPS), convert external AC power into DC power, and generate DC power necessary for image forming apparatus 100 by decompressing the converted DC power at a predetermined level. For instance, the power supply unit 110 may generate 24V DC power and 5V DC power. In the exemplary embodiment of the present general inventive concept, the power supply unit 110 is formed using a SMPS, but this is only an example. The power supply unit 110 may be realized using a transformer or a bridge rectifier circuit.

The switching unit 120 receives DC power from the power supply unit 110, and may switch power provided to each of the control unit 150 and a plurality of the function units 130. Specifically, the switching unit 120 may comprise a DC/DC converter 124 which converts the DC power of the power supply unit 110 into DC power at another level, and a plurality of switching elements 121, 122, 123, 125, 126 which provide the DC power of the power supply unit 110 and the converted DC power of the DC/DC converter 124 to each of the control unit 150 and a plurality of function units 131-136, under the control of the converter 124. Detailed structure and function of the switching unit 120 will be explained later with reference to FIG. 2.

The function unit 130 performs the functions of the image forming apparatus 100. Specifically, if the image forming apparatus 100 is a multi-functional printer capable of performing faxing, printing, copying, and scanning, the image forming apparatus 100 may comprise a scanning unit to scan documents, a communication unit to transmit or receive a fax or to transmit or receive print data to or from an external printing control apparatus, an engine or motor unit to print documents, and an image processing unit to process print data and scanned image data. The function unit 130 may include one or more of a scanning unit, a communication unit, an engine or motor unit, and an image processing unit, as described above. The function unit 130 may also include various function units related to the functions of an image forming apparatus in addition to the function units described above.

The power management unit 140 receives DC power of the power supply unit 110 and controls the switching operation of the switching unit 120 according to the operation mode of the image forming apparatus 100. Specifically, the power management unit 140 may cut off or supply power to the function unit 130 and the control unit 150 according to the operation mode of the image forming apparatus 100. For instance, if the operation mode of the image forming apparatus 100 is a wake-up mode, the power management unit 140 may output a turn-on signal for all switching elements 121, 122, 123 of the switching unit 120 so that power is provided to every function unit 130. In this case, the power management unit 140 may output a turn-on signal for the plurality of switching elements 121, 122, 123 sequentially so that DC power generated by the power supply unit 110 does not drop.

If the operation mode of the image forming apparatus 100 is changed from a ready mode to a power save mode, the power management unit 140 may control the switching unit 120 so that power provided to the plurality of function units 130 is cut off. If the operation mode is changed to an off mode in which power needs to be saved more than in a power save mode, the power management unit 140 may control the switching unit 120 so that power provided to the control unit 150 and the converter 124 is cut off. As such, in an exemplary embodiment of the present general inventive concept, the image forming apparatus 100 cuts off power not only to the function unit 130, but also to the control unit 150 in a power save mode, and thus may maintain standby power at less than 1 W.

If the operation mode of the image forming apparatus 100 is changed to a switch off mode, the power management unit 140 controls at least one of the plurality of switching elements 121, 122, 123 of the switching unit 120 to be turned on so as to discharge an electric charge accumulated in the image forming apparatus 100. Specifically, if a 'power-off' command is received from a user, the power management unit 140 may control the power supply unit 110 to stop its operation, and control the switching unit 120 so as to discharge an electric charge accumulated in the image forming apparatus 100. In addition, when the AC power provided to the power supply unit 110 is cut off, the power management unit 140 may control the power supply unit 110 to stop its operation and control the switching unit 120 so as to discharge an electric charge accumulated in the image forming apparatus 100.

If the operation mode of the image forming apparatus 100 is a printing mode, the power management unit 140 may control the switching unit 120 so that power is supplied only to the function unit 130 necessary to perform a printing job and power is cut off in other function units 130. The control method of the power management unit 140 may be implemented using an optimum algorithm, and the algorithm may be stored in the storage unit 131 and be transmitted through the control unit 150 when initializing the image forming apparatus 100.

The control unit 150 may control the operation of a plurality of function units 130. Specifically, the control unit 150 may control the plurality of function units 130 to perform functions supported by the image forming apparatus 100.

In addition, the control unit 150 may determine the operation mode of the image forming apparatus 100. Specifically, if a predetermined time elapses in a standby mode without any operation, and thus the operation mode needs to be changed to a power save mode, an off mode, or an end mode, the control unit 150 may notify the power management unit 140 of the changed operation mode of the image forming apparatus 100. In an exemplary embodiment of the present general inventive concept, the operation mode of the image forming apparatus 100 is determined by the control unit 150, but this is only an example. The operation mode of the image forming apparatus 100 may be determined by the power management unit 140.

As described above, according to the exemplary embodiment of the present general inventive concept, the image forming apparatus 100 may cut off or supply power to a plurality of components of the image forming apparatus 100 depending on the operation mode, and thus it is easy to manage power. In addition, power supplied to the converter 124 and the control unit 150 may also be cut off according to the operation mode, so power in a standby mode may be reduced to less than 1 W.

Furthermore, even when the image forming apparatus 100 is in a wake-up state, power may not be provided to every component all at once, rather, power may be sequentially provided to necessary components so that the image forming apparatus 100 can be stably booted.

Figure 2A:
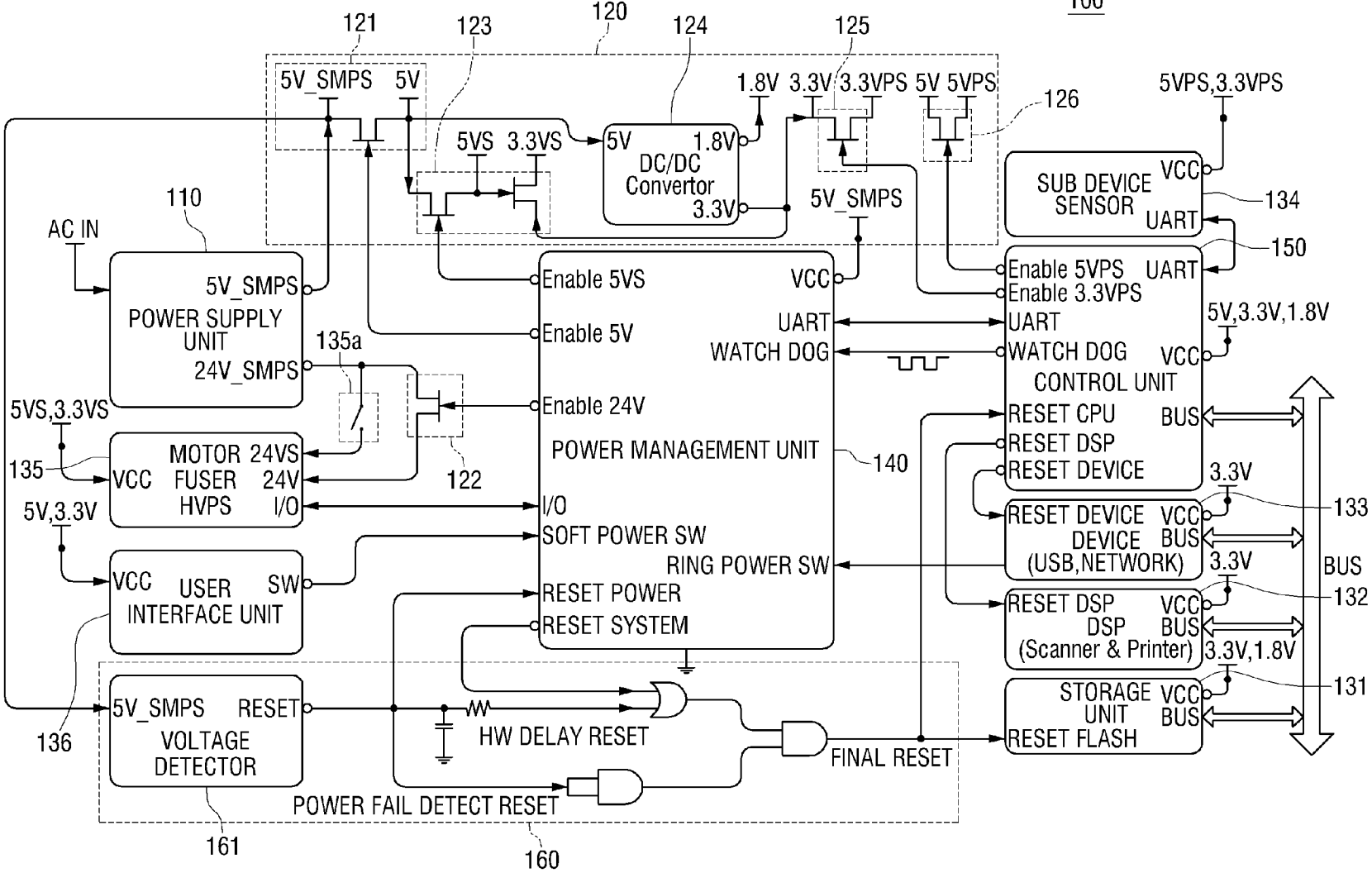
FIGS. 2A and 2B are circuit diagrams of an image forming apparatus according to exemplary embodiments of the present general inventive concept.

FIG. 2A is a circuit diagram of an image forming apparatus 100 according to an exemplary embodiment of the present general inventive concept.

The image forming apparatus 100 illustrated in FIG. 2A comprises the power supply unit 110, the switching unit 120, the function unit 130, including different function units 131, 132, 133, 134, 135, and 136, the power management unit 140, the control unit 150, and a reset unit 160.

In FIG. 2A, the function unit 130 may include a storage unit 131, such as a Flash DDR, to store an operation program of the image forming apparatus 100, an image processing unit, such as a DSP, 132 to perform image-processing on a scanned image and a received printing job, a communication function unit 133 to communicate with an external apparatus, a sensing unit 134 to sense and control a peripheral device, an engine function unit, such as a motor fuser HVPS, 135 ("motor unit") to perform a printing job, and a user interface unit 136. Although six function units are described in FIG. 2A, any of the six function units may be omitted from the image-forming apparatus 100 and other function units may be included in the image-forming apparatus 100 according to a desired function of the image-forming apparatus 100.

The power supply unit 110 may be a switching mode power supply (SMPS), and may generate external AC power as 24V DC power and 5V DC power. The power supply unit 110 may directly provide the generated 5V SMPS DC voltage to the power management unit 140 and the voltage detection unit, or voltage detector, 161 of the reset unit 160, and may provide power to other components via the switching unit 120.

The switching unit 120 may comprise the DC/DC converter 124 and a plurality of switching elements 121, 122, 123, 125, 126. The switching unit 120 may be a module including a plurality of switches, or it may comprise a plurality of switches located at different locations throughout the circuitry of the image-forming apparatus 100.

If the first switching element 121 is turned on, the DC/DC converter 124 may receive 5V DC power of the power supply unit 110 and generate 1.8V and 3.3V. FIG. 2A illustrates that 5V is received and 1.8V and 3.3V are generated, but this is only an example and other voltages may be received and generated. If the first switching element 121 is turned off, power provided to the DC/DC converter 124 is cut off.

One end of the first switching element 121 is connected to the 5V (5V SMPS) output end of the power supply unit 110 and the other end is connected to the DC/DC converter 124. The first switching element 121 receives a switching control signal from the power management unit 140. Accordingly, if the first switching element 121 is turned off, power provided to all elements except for the power management unit 140 and the reset unit 160 is cut off. In other words, power is turned off to the control unit 150 and the function unit 130 (including the storage unit 131, DSP 132, the communication device 133, the sub-device sensor 134, the motor unit 135, and user interface unit 136).

One end of the second switching element 122 is connected to the 24V (24V SMPS) output end of the power supply unit 110 and the other end is connected to the motor unit 135, and the second switching element 122 receives a switching control signal from the power management unit 140. Accordingly, when a printing job is not being performed, the power management unit 140 may control the second switching element 122 to be turned off so that 24V power provided to the motor unit 135 is cut off. The image-forming apparatus 100 may also include a manual switch 135*a*, or another switch that is not controlled by the power management unit 140, to bypass the power management unit 140 to supply power to the motor unit 135.

One end of the third switching element 123 is connected to the output end of the first switching element 121 and the other end is connected to the motor unit 135, and the third switching element 123 receives a switching control signal from the power management unit 140. Accordingly, when a printing job is not being performed, the power management unit 140 may control the third switching element 123 to be turned off so that 5V power ("5VS") and 3.3 V power ("3.3VS") provided to the engine function unit 135 is cut off. As illustrated in FIG. 2A, the third switching element 123 may include two transistors, where one terminal of the first resistor outputs a 5V (5VS) output and is connected to a gate of the second transistor. An output terminal of the second transistor may output 3.3V (3.3VS). Consequently, when the first transistor is turned off, the voltage to the gate of the second transistor is turned off, so each of the output voltages 5VS and 3.3VS are turned off.

One end of the fourth switching element 125 is connected to the 3.3V output end of the DC/DC converter 124 and the other end is connected to the function unit 134, and the fourth switching element 125 receives a switching control signal from the control unit 150. Accordingly, if a peripheral device of the image forming apparatus does not have to operate, the control unit 150 may control the fourth switching element 125 to be turned off so as to cut off 3.3V power provided to the function unit 134.

One end of the fifth element 126 is connected to the 5V output end of the first switching element 121 and the other end is connected to the function unit 134, and the fifth element 126 receives a switching control signal from the control unit 150. Accordingly, if a peripheral device of the image forming apparatus does not have to operate, the control unit 150 may control the fifth switching element 126 to be turned off so as to cut off 3.3V power provided to the function unit 134.

The power management unit 140 receives DC power (5V SMPS) of the power supply unit 110, and may control the switching operation of the switching elements 121, 122, 123 according to the operation mode of the image forming apparatus. The detailed controlling operation of the power management unit 140 will be explained later with reference to FIG. 3 and FIG. 4.

The control unit 150 controls the operation of a plurality of function units 130. The control unit 150 may control the switching operation of the switching elements 125 and 126 according to the operation mode of the image forming apparatus If the image forming apparatus 100 is booted, the control unit 150 may load a pre-stored program from the storage unit 131 and transmit an algorithm related to power management to the power management unit 140.

When the power supply unit 110 initially generates DC power (5V SMPS), the reset unit 160 generates a reset signal input to the power management unit 140 and a reset signal input to the control unit sequentially. Specifically, if the power supply unit 110 generates DC power (5V SMPS), the reset unit 160 may sense the power supply using the voltage detector 161 and generate a reset signal. The generated reset signal is directly input to the power management unit 140, and the power management unit 140 is reset and booted.

The reset signal generated by the voltage detector 161 is transmitted to a delay circuit and a plurality of logic gates. Specifically, the reset unit 160 may input a reset signal directly to the power management unit 140 and may transmit a delayed reset signal to the storage unit 131 and the control unit 150 through a delay circuit so that the reset signal generated by the power detector 161 can be transmitted to the power management unit 140, the storage unit 131, and the control unit 150 sequentially. In FIG. 2, the components of the storage unit 131 are not illustrated in detail. If, for example, the storage unit 131 is divided into ROM and RAM, the reset signal may be transmitted to the ROM first, and then transmitted to the RAM.

In the exemplary embodiment illustrated in FIG. 2A, the delay circuit is realized using resistance and capacitor, but the delay circuit may be realized using other elements and circuit components. Additionally, in the exemplary embodiment, the reset unit 160 is realized using a single OR logic element and two AND logic elements, but other logic elements and other circuit elements could be used to realize the reset unit 160.

As illustrated in FIG. 2A, even if a reset signal is generated following instant voltage drop of the power supply unit 110, the entire system may not be reset. In addition, as the power management unit 140 and the control unit 150 are reset sequentially, enough time can be secured to stabilize the system power before the control unit 150 is reset.

As illustrated in FIG. 2A, in addition to the power management functions illustrated above, the components of the image-forming apparatus 100 may include additional functions and connections. For example, the control unit 150 may include a watchdog timer to output a counter to the power management unit 140 if an error is detected or if no action is taken or command is given before a predetermined period of time. The power management unit 140 may initiate a power reboot if the watchdog timer counts up or down to a predetermined level.

In addition, various components of the image-forming apparatus 100 may be connected to transmit and receive data, including imaging data, command data, addresses, feedback, etc. FIG. 2A illustrates a sub-device sensor 134 connected to the control unit 150 via a Universal Asynchronous Receiver/Transmitter (UART) terminal to communicate data. In addition, the control unit 150 may be connected to the power management unit 140, or any other desired component, via a UART terminal.

One or more of the components of the image-forming apparatus 100 may be connected via a bus, such as a data bus, an address bus, or a command bus. For example, in FIG. 2A, the control unit 150, the communication device 133, the digital signal processor 132, and the storage device 131 all share at least one bus.

Figure 2B:
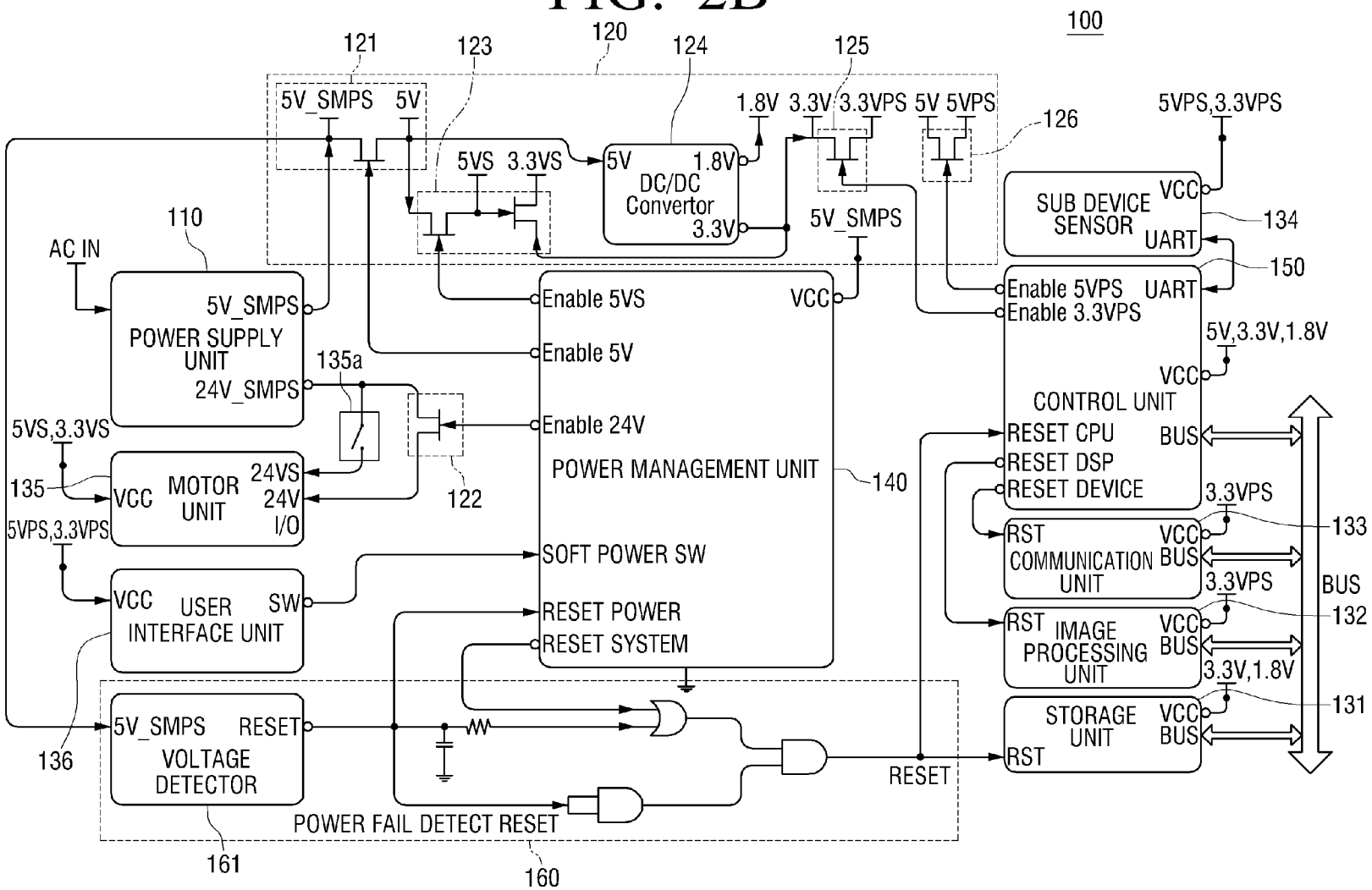

The order in which power is supplied to various components of the image-forming apparatus 100 may be varied by varying the switches to which the various components are connected. FIG. 2B illustrates a configuration of the image-forming apparatus 100 similar to that of FIG. 2A, except that functional units 132, 133, and 136 are connected to outputs of switches 125 and 126, instead of switch 121 and the DC/DC converter 124. Some communication connections between components are omitted from FIG. 2B for clarity.

Figure 3:
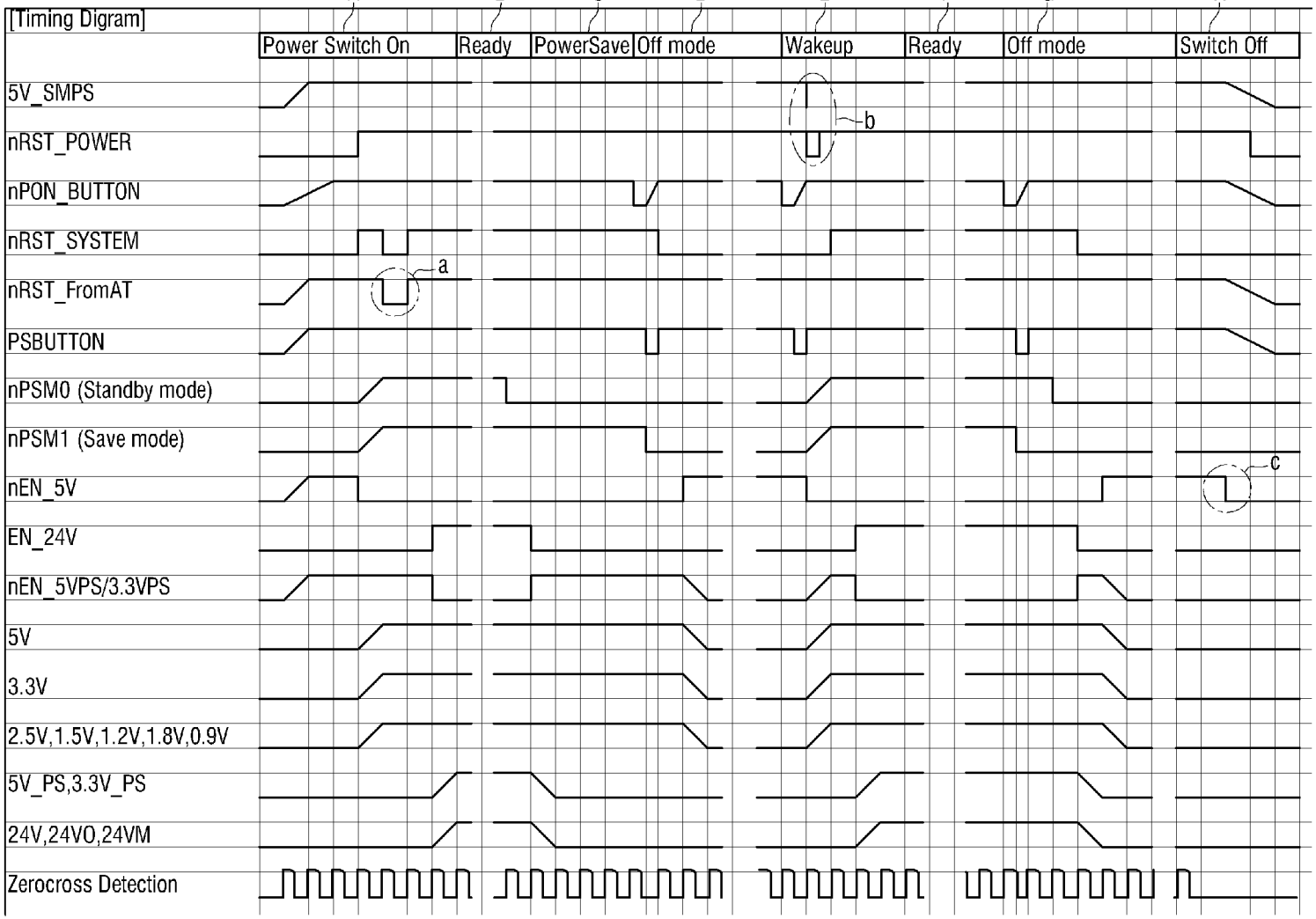
FIG. 3 is a waveform diagram provided to explain power output corresponding to each mode.

FIG. 3 is a waveform diagram provided to explain power output corresponding to each mode of the image-forming apparatus 100 illustrated in FIG. 2B. A power switch may be turned on in a first stage (mode A, "power switch on"). Specifically, if the switch of the image forming apparatus 100 is turned on and AC power is input, outputs of the power supply unit 110 increase to a 5V voltage (5V_SMPS) and 24V voltage (24V SMPS), and a 5V power signal (5V_SMPS) is provided to the power management unit 140.

When 5V_SMPS power is stabilized, the power detector 161 of the reset unit 160 generates a reset signal nRST_POWER, and the power management unit 140 is reset and booted. When the power management unit 140 is booted, the power management unit 140 provides power to the control unit 150 by applying an enable signal nEN__5V to the switching element 121. Enabling the switching element 121 results in an output of a 5V power signal ("5V") which is provided to the DC/DC converter 124 to output the 3.3V and 1.8V power output signals (only the 3.3V power output is illustrated in FIG. 3). As the delayed reset signal is provided to the control unit 150, the control unit 150 is booted after power is provided.

After the control unit 150 is booted, the switching elements 125 and 126 and the power management unit 140 are controlled in order to provide power to other components, and a reset signal is applied to peripheral devices and a plurality of function units 130 so that the image forming apparatus enters into a ready mode (mode B, "ready"). For example, the power management unit 140 may turn on the switches 125 and 126 to supply power to the functional units 132, 133, 134, and 136. In addition, the power management unit 140 may enable the switching element 123 to supply power to the motor unit 135.

After the ready mode passes and a predetermined time elapses, if a power save mode is needed (mode C, "power save"), the control unit 150 controls the switching element 125, 126 to cut off power provided to peripheral devices. Accordingly, power consumption of the image forming apparatus 100 may be reduced.

After the power save mode passes and a predetermined time elapses, if an off mode (mode D, "off mode") is needed, the control unit 150 notifies the power management unit 140 of the mode change to the off mode, and the power management unit 140 may control the switching unit 120 to cut off power provided to the function unit 130 (or the function units 132-136) and the control unit 150. Alternatively, the power management unit 140 may provide power only to the user interface unit 136 and the communication function unit 132 so that a control command by a user and a control command from a printing controlling apparatus (not shown) may be received. Accordingly, power consumption of the image forming apparatus 100 is reduced more than in the power save mode.

After the off mode passes and a control command by a user is received through the user interface unit 130 (mode E, "wakeup"), the power management unit 140 controls the switching unit 120 to provide power to the control unit 150 and the plurality of function units 130 and generates a system reset signal (nRST_SYSTEM) so as to be in a ready mode "F."

After the ready mode passes and a user command to enter into the off mode is received (mode G, "off mode"), the control unit 150 controls the switching elements 125 and 126 to cut off power provided to peripheral devices. In addition, the control unit 150 notifies the power management unit 140 of the mode change to the off mode, and the power management unit 140 may control the switching unit 120 to cut off power provided to the function units 131-136 and the control unit 150.

If a command to end a system is received by a user through the user interface unit 136 or external AC power is cut off (mode H, "switch off"), the power management unit 140 may generate a system reset signal to shut down power to the entire system of the image-forming apparatus 100 and to sequentially cut off the main power of such devices as the converter 124. The power management unit 140 may control at least one of the plurality of switching elements to be turned on so as to discharge an electric charge accumulated in a capacitor of the image forming apparatus 100 or in another electrical component.

Figure 4:
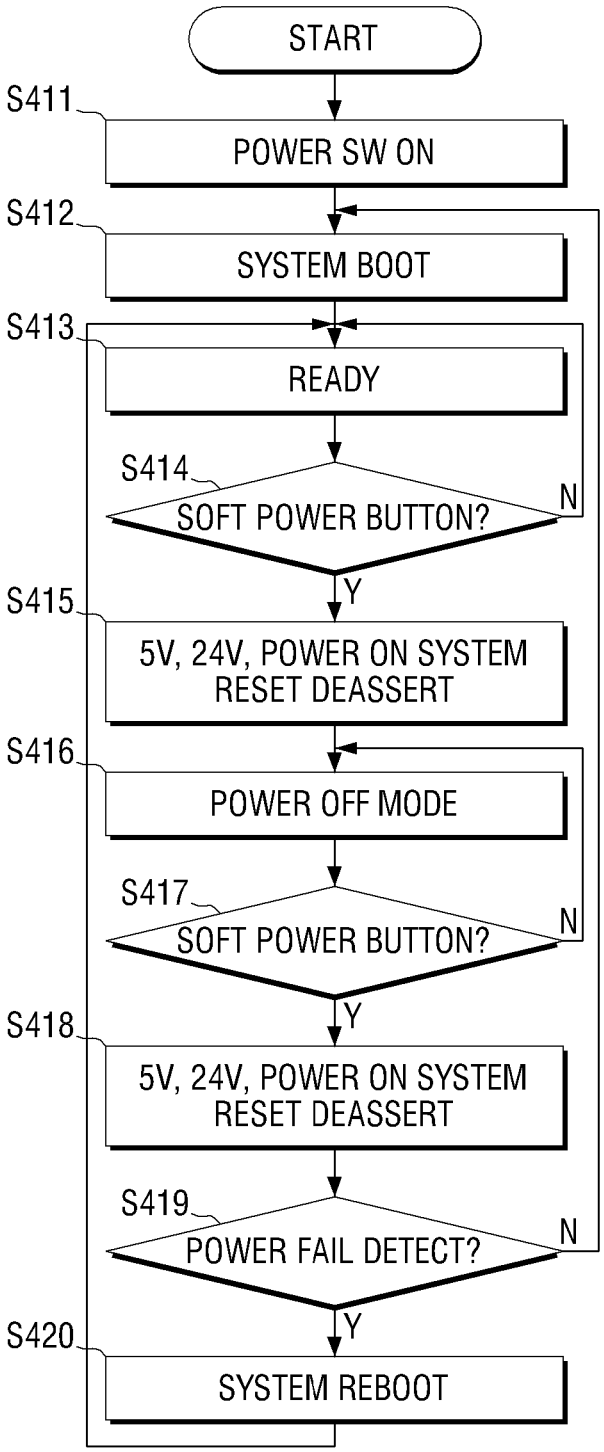
FIG. 4 is a flow chart provided to explain the operation of the power management unit illustrated in FIG. 1.

FIG. 4 is a flow chart illustrating the operation of the power management unit illustrated in FIG. 1. If the power switch of the image forming apparatus is turned on and AC power is applied to the power supply unit 110 (S411), the power management unit 140 performs booting of the control unit 150 through as illustrated in mode A in FIG. 3 (S412) so as to enter into a ready mode (S413).

If a command to enter into the power save mode or the off mode is received from a user or the control unit 150 (S414), the switching unit 120 may be controlled so that power corresponding to the power save mode and the off mode is provided to the function unit 130 and the control unit 150 (S415).

After the power save mode or the off mode starts (S416), if a command to enter into a standby mode is input from a user or the control unit 150 (S417), the switching unit 120 is controlled to provide power to the function unit 130 and the control unit 150 and a system reset signal may be transmitted to the control unit 150 (S418).

If power failure is detected due to power drop of AC power or unpredicted error, the power management unit 140 may transmit a system reset signal to the control unit 150 to reboot the system (S420).

Figure 5:
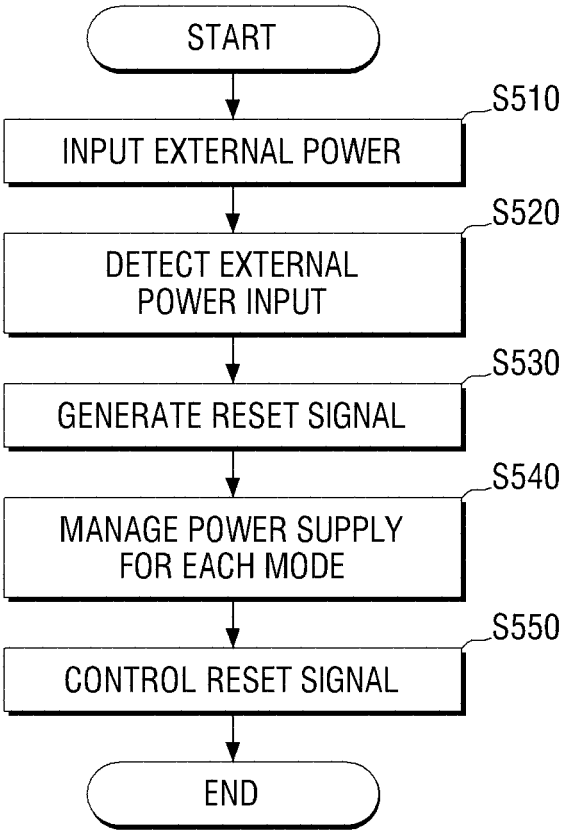
FIG. 5 is a flow chart provided to explain a method for controlling power according to an exemplary embodiment of the present general inventive concept.

FIG. 5 is a flow chart illustrating a method for controlling power according to an exemplary embodiment of the present general inventive concept.

When AC power is applied to the image forming apparatus 100 (S510), DC power may be generated. Specifically, if a power switch is turned on and AC power is applied to the image forming apparatus 100, 5V DC power is generated and supplied to the power management unit 140.

If external power is detected (S520), a reset signal to be input to the power management unit 140 and a reset signal to be input to the control unit 150 may be generated sequentially (S530). The reset signal transmitted to the power management unit 140 causes the power management unit 140 to boot.

The booted power management unit 140 may control power provided to the control unit 150 and a plurality of function units 130 according to the operation mode of the image forming apparatus 100 (S540). Such operation of the power management unit 140 has already been explained with reference to FIGS. 1 to 4 and is omitted here.

In addition, the power management unit 140 may generate a system reset signal of the control unit 150 according to an operation mode, and the control unit 150 may generate a reset signal for a plurality of function units according to an operation mode and manage the system (S550).

According to the present general inventive concept, the image forming apparatus 100 may control power supply to a plurality of components of the image forming apparatus individually, and thus power management may become easier. In addition, the power provided to a converter and a control unit may be cut off, thereby reducing power consumption to less than 1 W. The method for managing power illustrated in FIG. 5 may be applied to the image forming apparatus having the configuration of FIG. 1, and may also be applied to an image forming apparatus having other configuration.

Figure 6A:
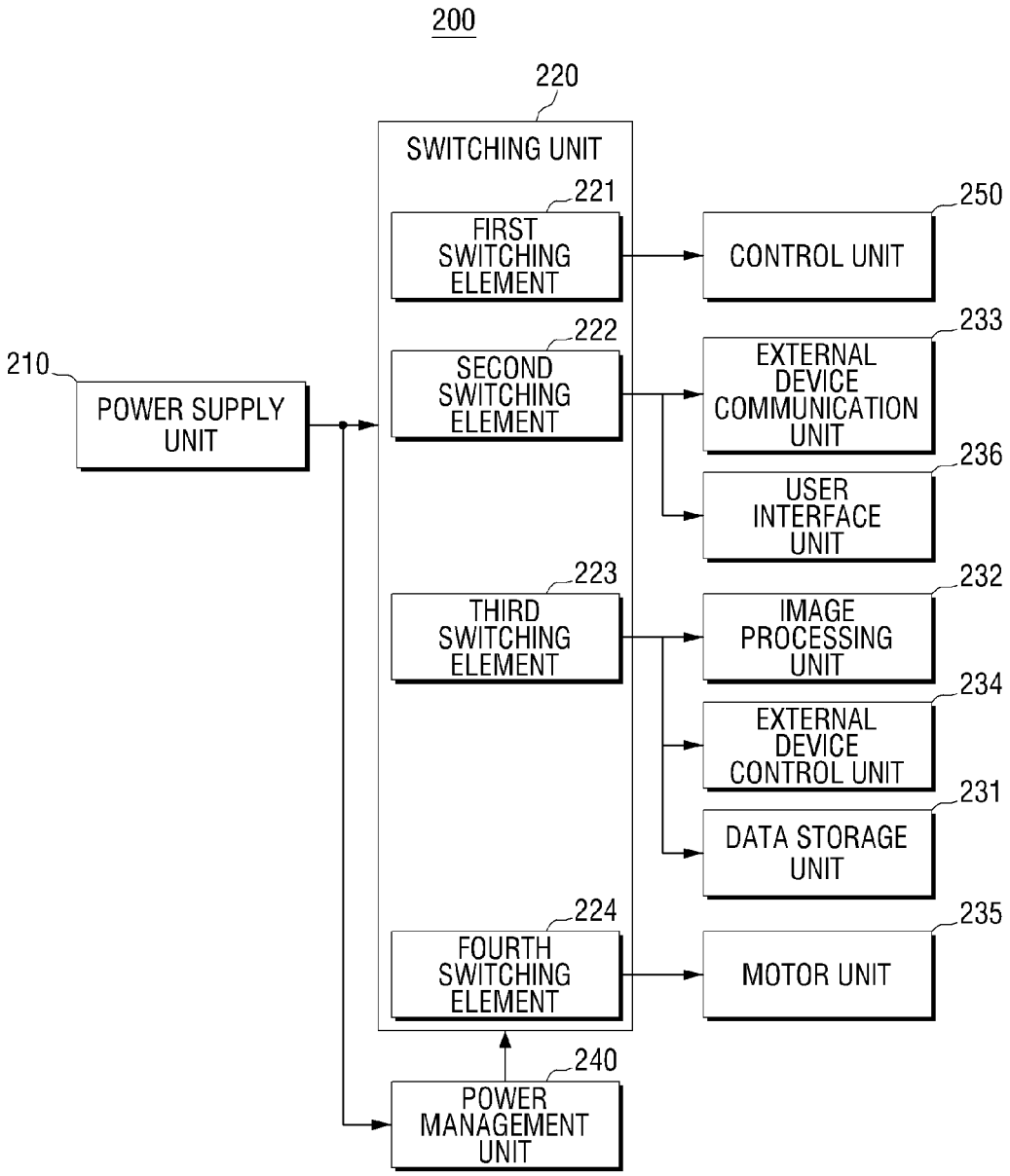
FIGS. 6A-6C illustrate block diagrams of an image-forming apparatus according to embodiments of the present general inventive concept.
Figure 6B:
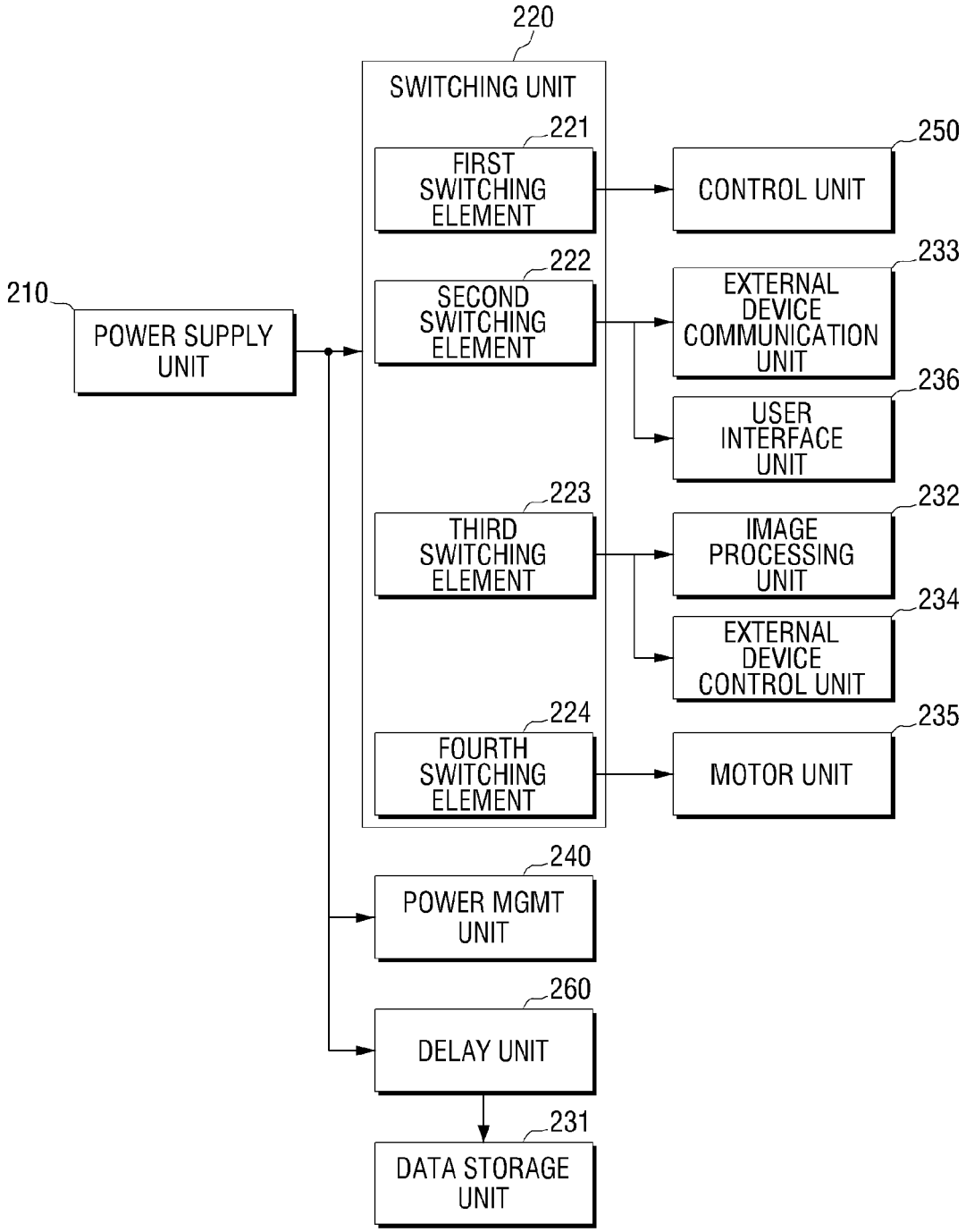

FIGS. 6A and 6B are block diagrams that illustrate examples of an image-forming apparatus 200 according to embodiments of the present general inventive concept. The image-forming apparatus 200 of FIGS. 6A and 6B are similar to the image-forming apparatus 100 of FIGS. 1 and 2. As illustrated in FIG. 6A, the image-forming apparatus 200 may include a power supply unit 210 to supply power to a plurality of function units via a switching unit 220. Upon receiving external power, the power supply unit 210 may output power signals to the switching unit 220 and to a power management unit 240. The power management unit 240 may control the first through fourth switching elements 221-224 to supply power to the functional units. For example, the power management unit 240 may first control the first switching element 221 to supply power to the control unit 250 before supplying power to the remaining functional units 231-236. Next, the power management unit 240 may control the second and third switching elements 222 and 223 to supply power to the external device communication unit 233, the user interface unit 236, the image processing unit 232, the external device control unit 234, and the data storage unit 231. Finally, if needed, for example, if a printing or copying operation is to be performed, the power management unit 240 may control the fourth switching element 224 to supply power to the motor unit 235.

Alternatively, as illustrated in FIG. 6B, the power supply unit 210 may output power to the power management unit 240 and the switching unit 220 directly. The power supply unit 210 may also output power to a delay unit 260, which may include delay circuitry including one or more capacitors, resistors, and/or transistors, for example, and power from the power supply unit 210 may be output to the data storage unit 231 or another functional unit after it is received by the power management unit 240. This may allow the data storage unit 231 to be operational to transmit program data to the control unit 250 when the control unit 250 powers up, for example. As an example of a delay unit 260, a plurality of inverters may be connected in series.

Figure 6C:
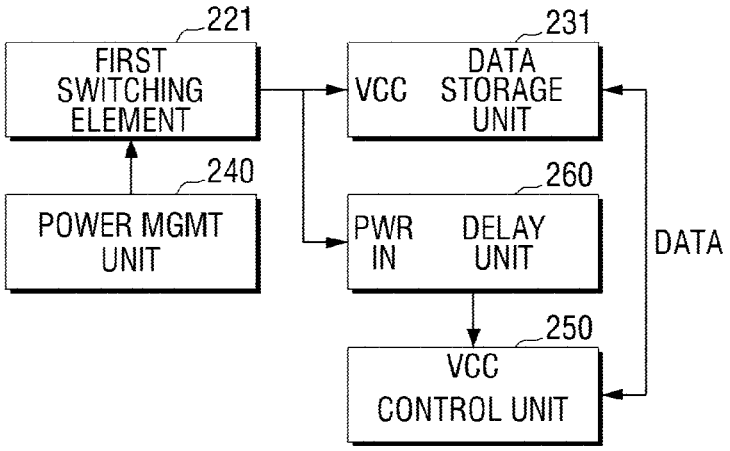

According to yet another alternative, as illustrated in FIG. 6C, power from the first switching element 221 may be output to a delay circuit 260 and to the data storage unit 231. Then, after a delay, the power from the first switching element 221 may power up the control unit 250 which may access data in the data storage unit 231.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus including a plurality of operation modes, the image forming apparatus comprising:

a power supply unit to generate DC power;

a function unit to perform a function of the image forming apparatus;

a control unit to control an operation of the function unit; and a switching unit to receive the DC power from the power supply unit and to selectively provide power to any one of the control unit and the function unit based on a present operation mode of the image forming apparatus.

2. The image forming apparatus of claim 1, further comprising:

a power management unit to receive the DC power from the power supply unit and to selectively control a switching operation of the switching unit between each of the function unit and the control unit based on the present operation mode of the image forming apparatus.

3. The image forming apparatus of claim 2, wherein the switching unit comprises:

a converter to convert DC power of the power supply unit having a first level into another DC power having another level; and a plurality of switching elements to provide the DC power having the first level and the DC power from the converter to the control unit and to the function unit, respectively.

4. The image forming apparatus of claim 3, wherein the power management unit controls the plurality of switching elements to be turned on sequentially in a wake-up mode.

5. The image forming apparatus of claim 3, wherein, in a power-off mode, the power management unit controls the plurality of switching elements so that at least one of the plurality of switching elements is turned on to discharge an electric charge accumulated in the image forming apparatus.

6. The image forming apparatus of claim 4, wherein the power-off mode is a mode in which a command to turn off power is received from a user, or in which an AC power input to the image forming apparatus is turned off.

7. The image forming apparatus of claim 1, further comprising:

a reset unit to generate a reset signal input to the power management unit and another reset signal input to the control unit sequentially when the power supply unit generates the DC power.

8. The image forming apparatus of claim 7, wherein the reset unit generates a reset signal to be input to the power management unit, and then generates a reset signal to be input to the control unit if a predetermined time elapses or a system reset signal is received from the power management unit.

9. The image forming apparatus of claim 8, wherein the predetermined time is a stabilization time of the power management unit.

10. The image forming apparatus of claim 7, further comprising:

a storage unit to store a program related to an operation of the image forming apparatus, wherein the reset unit generates a reset signal of the control unit after generating a reset signal of the storage unit.

11. The image-forming apparatus according to claim 7, further comprising:

at least one data storage device, wherein the reset unit includes a delay circuit to receive the reset signal and to output a delayed reset signal to the at least one data storage device.

12. The image-forming apparatus according to claim 11, wherein reset unit outputs the another reset signal to the control unit to simultaneously output the delayed reset signal to the data storage device and the control unit.

13. The image forming apparatus of claim 1, wherein the control unit generates a reset signal of the function unit according to the present operation mode of the image forming apparatus.

14. A method of managing power of an image forming apparatus including a plurality of operation modes, the method comprising:

generating DC power;

inputting the DC power to a power management unit of the image forming apparatus; and controlling power to be selectively provided by the power management unit to a control unit and a function unit of the image forming apparatus based on a present operating mode of the image forming apparatus, by the power management unit.

* * * * *